United States Patent [19]

Butler

[11] Patent Number: 4,739,603

[45] **Date of Patent: * Apr. 26, 1988**

[54] SIMULATED THATCHED ROOFING

[76] Inventor: Delicia M. Butler, 21955 Cayuga La., El Toro, Calif. 92630

[ * ] Notice: The portion of the term of this patent subsequent to Apr. 22, 2003 has been disclaimed.

[21] Appl. No.: 830,626

[22] Filed: Feb. 18, 1986

Related U.S. Application Data

[63] Continuation-in-part of Ser. No. 617,705, Jun. 6, 1984, Pat. No. 4,583,344.

[51] Int. Cl.[4] ..... E04B 1/00

[52] U.S. Cl. ..... 52/750; 428/17

[58] Field of Search ..... 52/750; 428/17, 95, 428/245, 246, 247, 286, 314.4

[56] References Cited

U.S. PATENT DOCUMENTS

| | | | |
|---|---|---|---|
| 1,949,068 | 2/1934 | Achterhof | 428/95 |
| 3,332,828 | 7/1967 | Faria et al. | 428/17 |
| 4,010,301 | 3/1977 | Anderson et al. | 428/95 |
| 4,140,825 | 2/1979 | Koschorrek | 52/750 |
| 4,583,344 | 4/1986 | Butler | 52/750 |

FOREIGN PATENT DOCUMENTS

| | | | |
|---|---|---|---|
| 1002620 | 8/1965 | United Kingdom | 52/750 |

*Primary Examiner*—James L. Ridgill, Jr.

*Attorney, Agent, or Firm*—Plante, Strauss, Vanderburgh

[57] ABSTRACT

There is disclosed a simulated thatched roofing which closely approximates the appearance and durability of thatched roofs. The roof structure includes a supporting roof structure formed of a roof frame and a base underlayment and a natural or synthetic fiber outer covering laid thereover which is formed of a base sheet, which can be woven or unwoven fabric, with or without a laminated layer of a synthetic resin, or can be a layer of a natural or synthetic resin in which a plurality of discontinuous loops of a synthetic or natural, raw bast or leaf fiber are embedded. The loops are cut to the ends of the fibers as tufts which are closely spaced across the entire surface of the roof covering, and which simulate the cut ends of reeds used in traditional roof thatching.

22 Claims, 3 Drawing Sheets

SIMULATED THATCHED ROOFING

BACKGROUND OF THE INVENTION

1. Field of Invention

This invention relates to a roof covering and, in particular, to a roof covering which simulates thatched roofs.

2. Brief Statement of the Prior Art

Thatched roofing is an ancient art practiced in the European countries. Although no other roof covering conveys the charm and quaintness of thatched roofs, there are a number of limitations which severly limit the use of thatching as roof coverings for modern dwellings.

Thatched roofing is conventionally formed by many bundles of water reeds which are laid over the roof and secured to the suppor-ting rafters by highly skilled workmen. The water reeds are secured to the roof rafters with steel sways, which are cables that are laid horizontally across the roof and secured to the roof by metal hooks which are passed through the thatching and pounded into the rafters. These hooks have an outer hook-end that engages the steel sways. The bundles of water reeds are applied on the roof quite thickly, typically thatched roofs have thicknesses of reeds from 9 to 12 inches, thus requiring a very high quantity of reeds. The cut ends of the reeds are exposed to view and weather. Because the water repellency of the reed requires flow of the water, thatched roofs must be very steeply sloped; 45 degrees or greater being required. As a consequence, the roofs of most modern dwellings are not susceptible to thatched coverings.

The thatched roofing also does not adapt well to roof openings and vent pipes must be stacked together to reduce the number of these openings which must be provided. This severely limits new construction and virtually precludes its application to existing dwellings. Also skylights are very difficult to seal with thatching and are essentially prohibited with thatched roofs.

Despite the aforementioned disadvantages, all of which are reflected by roofing costs which exceed by many times the cost of the next most expensive roof covering, there remains a market for this roof covering where charm and picturesque appearances are desired. This market could be greatly expanded with a substitute which would be less labor and material intensive and accordingly a need exists for a roof covering that would simulate thatched roofing without requiring the vast amount of labor and materials inherent in the ancient art of roof thatching.

RELATED APPLICATION

This application is a contination-in-part of my parent application, Ser. No. 617,705, filed June 6, 1984, now U.S. Pat. No. 4,583,344, which discloses and claims a roof covering having a woven backing with a cut pile formed by natural, bast or leaf fiber. This application relates to the same type of roof covering, however, it discloses coverings with plastic foam or resin backings, and cut pile synthetic fibers.

BRIEF DESCRIPTION OF THE INVENTION

This invention comprises a simulated thatched roofing in which the roof underlayment is covered with an outer covering formed of a backing layer, which can be a fabric of woven or otherwise consolidated fibers, into which is interwoven a plurality of discontinuous loops of a natural or synthetic fiber. Alternatively, the backing layer can be layer of a natural or synthetic resin and the discontinuous fibers can be embedded in the layer of resin. Any suitable fiber which, when cut will give the appearance of cut ends of water reeds can be used for the discontinuous fibers, however, a natural, raw fiber is preferred, such as a bast or leaf fiber. The exposed ends of the fiber are cut, forming a cut pile covering in which the tufts of cut pile extend substantially across the entire sheet of the backing fabric. Preferably, the backing fabric is coated with a polymer such as an elastomer, to impart strength and durability. The fibers which are used are vegetable fibers, preferably raw hemp, sisal or abaca fibers. Surprisingly it has been found that the appearance and texture of such a covering very closely simulates the appearance and texture of a thatched roof covering to the point where it is only discernable by a trained eye and at a close distance.

BRIEF DESCRIPTION OF THE DRAWINGS

The invention will be described with reference to the FIGURES, of which.

DESCRIPTION OF PREFERRED EMBODIMENTS

Figure 1:
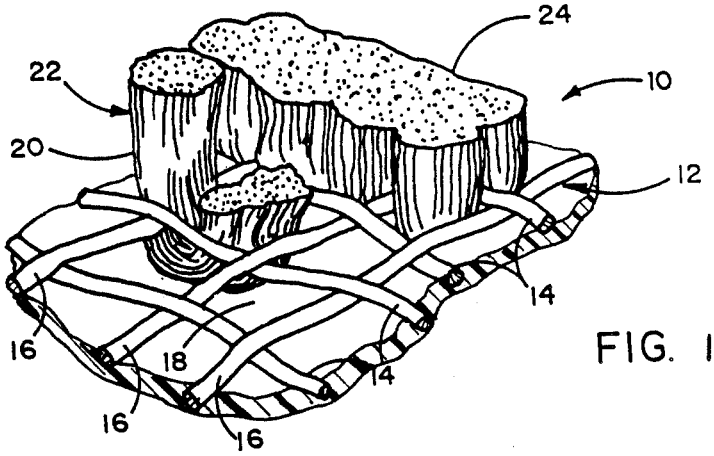
FIG. 1 illustrates an embodiment of the outer roof covering of the invention which has a woven fabric backing.

Referring now to FIG. 1, one embodiment of the invention is shown as an outer covering 10. The outer covering 10 includes a mat 12 of a woven backing fabric 11 having cross strands 14 and longitudinal strands 16 all closely spaced. The fiber or continuous strands 14 and 16 used for forming the woven backing 11 for mat 12 used in the invention can be formed of any suitable material, including even metallic wire, and can be of the same material used for the discontinuous loops 20. The fibers used for loops 20 can be any natural or synthetic fiber, however, it is preferred to use those fibers which have the closest appearance to cut ends of water reed, the thatching, which has traditionally been used for roof thatching. Examples of preferred fibers are natural bast and leaf fibers which can be used in their raw, unpurified state. The fibers, regardless of source or composition, are twisted into individual strands of substantial diameter, e.g., from about 0.1 to about 0.5 inch. Each of the interstices 18 between the woven strands 14 and 16 is penetrated by a strand 20 of a discontinuous loop 22. The discontinuous loops 22 are formed with a single strand of the twisted fibers which passes through an interstice 18, reverses and is passed upwardly through the next open interstice 18. The ends of the discontinuous loops are cut at the same level shown at 24 to provide a continuous surface of cut fiber ends, i.e., a cut pile. For use in the invention, the thickness of the covering can be varied considerably; thicknesses from ¼ inch to about 3 inches can be used. Preferably the coverings are used with thicknesses from about ½ inch to about 1½ inch.

Figure 2:
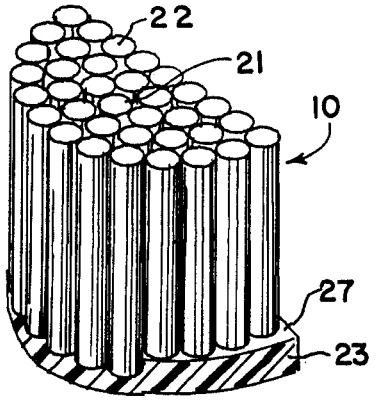
FIG. 2 illustrates an embodiment of the outer roof covering which has a nonwoven fabric backing.

Referring now to FIG. 2, an alternative covering is illustrated. In this covering 13, the backing fabric 19 is a layer of randomly oriented fibers 15 which are consolidated into a cohesive layer by a coating of a suitable resin, which coats the fibers and forms a film 17 across the interstices between adjacent fibers. Suitable adhesive and film forming resins for this purpose include the elastomeric resins such as natural and synthetic rubber, polyurethanes, and polyvinyl and acrylic resins, described in greater detail hereinafter. As with the embodiment described with regard to FIG. 1, the individual fibers can be twisted into individual strands of substantial diameter. The loops 20 of fibers penetrate the backing fabric, with each discontinuous loop 22 being formed with a single strand of the twisted fibers which passes through the backing fabric 19, reverses and passes upwardly back through the backing fabric 19. Again, the ends of the discontinuous loops are cut at the same level shown at 24 to provide a continuous surface of cut fiber ends, i.e., a cut pile. As with the FIG. 1 embodiment, the thickness of the covering can be varied considerably; thicknesses from ¼ inch to about 3 inches can be used. Preferably the coverings are used with thicknesses from about ½ inch to about 1½ inch.

Referring now to both FIGS. 1 and 2, the backing fabric, 12 or 19, is covered with a coating 21 of a suitable resin, which is preferably an elastomeric foam resin, but which can also be unfoamed, solid core resin, and can be of a polyurethane, vinyl or acrylic resin. The coating 21 is applied at a distribution from about 1 to about 30 ounces per square yard of backing fabric, preferably from about 2 to about 10 ounces per square yard, sufficient to impart a dimensional stability and durability to the final product.

The resin coating 21 can be preformed as a thin layer of formed or solid core resin and the resultant sheet or film can be laminated to the back of the backing fabric. More preferably, the coating is applied as a liquid, and is cured into a solid coating after its application to the backing fabric. When applied as a liquid, the resin can be applied in a molten state, however, it is preferably applied as a liquid solution or suspension. While solutions of the aforementioned resins in suitable solvents can be used, a latex containing from about 30 to 75 weight percent of the resin coating is preferred. The resin coating is applied by spraying or rolling the resin, preferably a latex of the resin, onto the backing fabric, after the aforementioned discontinuous loops 22 have been formed onto the backing fabric. After coating with the resin, the resin is cured, usually by heating to moderate temperatures, e.g., to 250° F. to about 375° F. for sufficient time to effect the curing, e.g., from 2 to about 60 minutes.

The preferred resin is an elastomer, e.g., natural or synthetic rubber. Examples of the latter are: polymers and copolymers of styrene, butadiene, and isoprene. Other elastomeric resins include the block copolymers of butadiene and styrene with polystyrene, polyurethane or polyester; polyurethane block polymers and polyester/polyether block polymers such as crystalline blocks of polyurethane or polyesters with alternating blocks of amorphous blocks of polyesters or polyethers. Elastomeric polyolefin blends of polypropylene or polyethylene and slightly crosslinked polyolefins. Silicon rubbers, i.e., elastomeric silicone resins, can also be, however, these are less preferred because of their relatively high cost.

Other resins can be used, such as vinyl resins, which are polymers of vinyl chloride or copolymers of vinyl chloride with other monomers such as vinylidiene chloride, acrylates, acrylonitrile, as well as polyvinyl acetate and copolymers with olefins such as ethylene, and copolymerizable acids or their esters, such as alkyl acrylic, methacrylic acid, maleic acid, ethyl acrylate, propyl maleate, methyl methacrylate; polyvinyl alcohols, polyvinyl formal.

The aforementioned resins are often formulated with various additives to enhance adhesiveness and strength and filled with finely subdivided inorganic materials such as clays, silica gel, and pigments such as metal oxides and chromates to obtain the desired color, e.g., titanium oxide, zinc oxide, etc.

The foamed resin backing can be obtained by incorporating a foaming agent in the resin. Foaming agents which are selected depend substantially on the particular resin, and whether it is applied in a solution with a solvent or as a latex. Examples of useful foaming agents are physical foaming agents such as volatile liquids and compressed gases, e.g., aliphatic hydrocarbons and halogenated derivatives such as fluorocarbons, etc.; and chemical foaming agents such as water and isocyanate for polyurethanes, and azobisformamide for most other resins.

Figure 3:
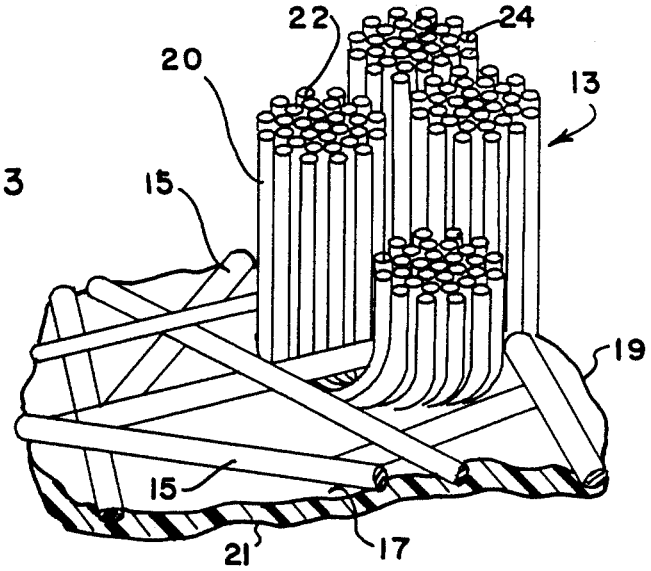
FIG. 3 illustrates an embodiment of the outer roof covering which has a synthetic resin backing.

Another embodiment of the outer covering 10 is shown by FIG. 3. In this embodiment, the tufts 21 of the natural or synthetic fibers, which simulate the appearance of water reed thatching, are embedded in a layer 23 of a natural or synthetic resin, e.g., any of the aforementioned elastomeric resins, polyvinyl resins, or acrylic resins. This embodiment differs from those of FIGS. 1 and 2 in that a backing fabric is not used, resulting in a covering in which the strands 20 of discontinuous loops 22 of fibers, which are any of the aforementioned fibers that simulate the cut ends of water reeds. The loops 22 of these fibers can be fused directly into a resin layer, such as a layer 27 of any of the aforementioned elastomeric or polyvinyl resins. In this application, the layer 27 is typically from 0.1 to about 1.0 inch, preferably from about 0.25 to about 0.5 inch in thickness, and is preferably in an unfoamed state, for maximum strength and toughness. The discontinuous loops 22 can be fused into the layer 27 by embedding the loops 22 into the prepolymer, i.e., into the resin while it is in a molten or liquid condition, and prior to curing of the resin. Once the resin is cured, or completely polymerized, the loops 22 will be permanently secured in the layer 27. The particular curing or polymerization step which is used in such manufacture will depend on the particular resin which is selected for the layer 27. Usually such resins are cured or crosslinked by an initiator in the resin which is activated upon heating, and the curing step thus comprises heating of the resin layer which contains the discontinuous loops 22 of fibers. As with the previously discussed embodiments, the loops 22 can be cut before or after formation of the covering, and will, in either method, provide a cut pile covering which simulates the cut ends of water reeds. A preferred example of a suitable covering of this construction has a polyvinyl chloride backing of a thickness from 0.25 to 0.375 inch with embedded coir fibers, which are fibers from the outer husks of coconuts.

Figure 4:
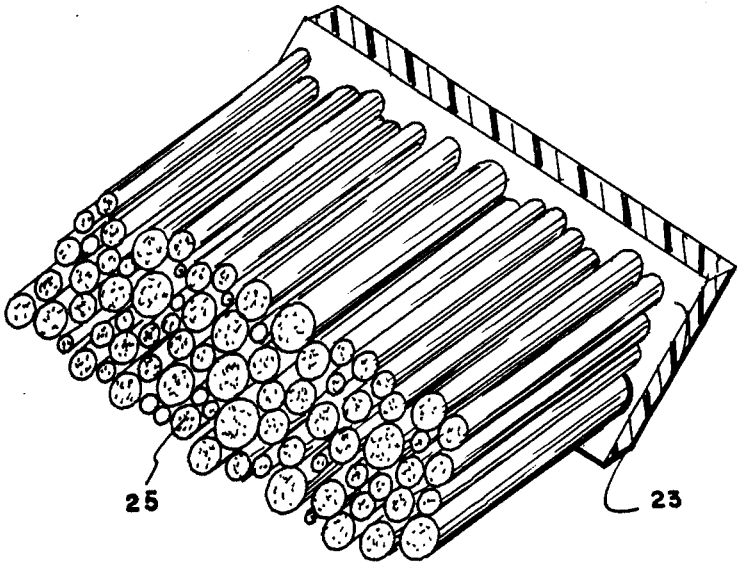
FIG. 4 illustrates an embodiment in which natural reeds are used.

A particularly useful variation of the embodiment of FIG. 3 is that shown in FIG. 4, in which the fibers are lengths of reeds, such as the water reeds which have conventionally been used for roof thatching. In this embodiment, the layer 23 of natural or synthetic resin serves to retain and align a plurality of cut lengths of reeds 25, which are embedded in the layer 23 at an angle from about 35° to about 65°, preferably from 40° to 50°. The reeds 25 are cut at a suitable length, e.g., from about 2 to about 24 inches, preferably from about 3 to about 10 inches, so that when the covering is laid on a sloped roof at an angle from about 25° to about 45°, the reeds 25 nest in a packed array, with only their cut ends exposed. To insure proper drainage of water from the roof, it is preferred to use a covering in which the angle at which the reeds are embedded in the layer 23 is less than the angle of inclination of the roof, resulting in positioning the reeds at an inclination from the horizontal with their exposed cut ends at a lower elevation than the ends which are embedded in the layer 23, all as shown in FIG. 4.

The result is a simulated thatched roof which is virtually indistinguishable from a traditional thatched roof since the same reeds are used in the simulation as are used in traditional thatching. A considerable savings in construction time is achieved, however, as the set of embedding the fibers in the layer 23 can be automated in a factory, and the assembled covering can be simply applied to a roof, using the covering in a roll of continuous covering in widths up to 6 to 10 feet, or individual tiles, as described herein for the other embodiments.

The outer covering 10 with any of the aforementioned embodiments can be obtained in virtually unlimited surface area. It is preferred to use an outer layer 10 which is substantially the same area as the roof to be covered, thereby eliminating joined edges in the covering. In many applications, this will, of course, not be possible and the outer layers can be joined and seamed in the manner hereinafter described. Alternatively, the outer covering can be obtained and applied as a plurality of tiles having dimensions between 8 to about 48 inches, typically as square or rectangular tiles having dimensions from 12 to 24 inches.

Figure 5:
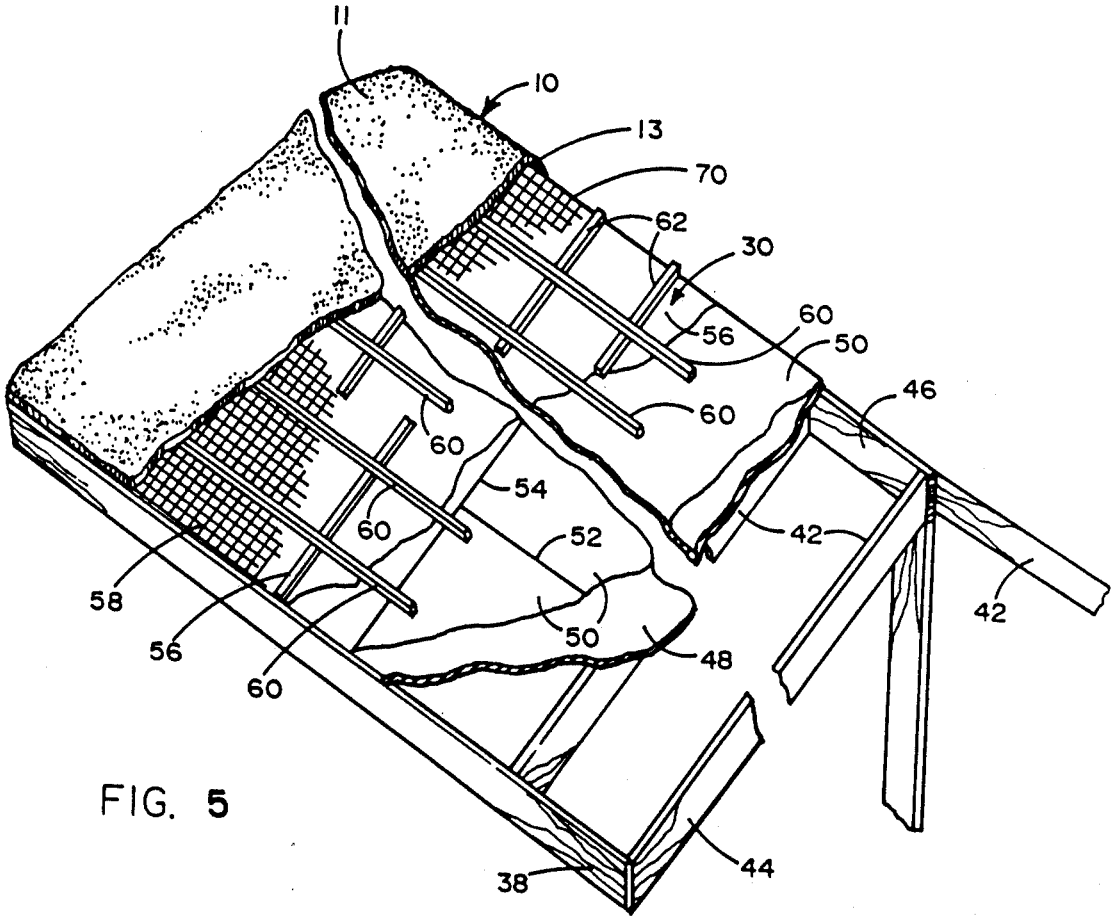
FIG. 5 is a view of a roof in accordance with the invention with successive layers cut away.

Referring now to FIG. 5, the construction of the roof utilizing the outer covering of the invention will be described. As illustrated, a roof 30 is formed with a supporting structure, including rafters 42, which rest on the plate 44 and which extend upwardly to attachment to the ridge beam 46. At their lower ends, the rafters 42 support a fascia board 38, all as in conventional construction. The invention is applicable to roofs of conventional construction including hip roofs, gabled roofs, and a variety of roofs all having valleys and rises as in conventional construction.

The roof construction, to meet most building code requirements, will have a sheathing 48 installed which can be coextensive with surface of the 30 and can be formed of exterior grade plywood having a thickness from about $\frac{3}{8}$ to about $\frac{3}{4}$ inch. The adjacent edges of the plywood are butted together and the entire sheathing is then covered with a water impermeable barrier. While plastic film such as polyethylene, polypropylene, polyvinylchloride, etc. having a thickness from about 3 to about 10 mils can be used for this purpose, most building code requirements call for the use of resin impregnated paper 50, which is primarily a petroleum resin impregnated paper having a weight from about 20 to about 50 pounds. The aforementioned paper 50 is applied in the customary fashion, with considerable overlapping of the paper 50 at adjacent edges 52 and 54 and the entire surface is then usually coated with a liquid resin 56 in a solvent or emulsion which solidifies into a tacky water impermeable coating.

A fire barrier can also be installed when it is desired to meet certain fire standards. This barrier would include a layer of gypsum board coextensive with the entire roof area, either applied directly over the rafters 44 or laid over a sheathing layer 48. Gypsum board with a thickness from about $\frac{3}{8}$ to about $\frac{3}{4}$ inch is suitable for this application.

The roof underlayment can also include a layer of a metal screen 58 having a sufficiently closely spaced screen wire to prevent intrusion of rodents. Suitably spaced screens would be screens having mesh sizes from about $\frac{1}{8}$ to about 1 inch, preferable from about $\frac{1}{8}$ to about $\frac{3}{4}$ inch. The screen can be laid, as illustrated, over the water impermeable coatings of the resin impregnated paper 50 and the resin coating 58 or, if desired, can be applied directly on the wood sheathing 48 and covered by the water impermeable barrier. The latter application avoids the necessity for use of corrosion resistant wire in the screen and permits the use of ordinary or mild steel wire for the screen. Otherwise, corrosion resistant screen material such as stainless steel or galvanized wire should be used.

The underlayment can also include a plurality of battens 60 which can be applied horizontally or vertically on the roof, or a combination of vertical and horizontal battens 60 can be laid in a gridwork across a plurality of vertical battens 62. The vertical battens can be located directy over the rafters to provide a firm support for the horizontal battens. The battens are desirable in the construction since they provide an airspace and provision for breathing of the outer covering 10 on the roof.

The outer covering 10 of the tuffed, raw, unpurified vegetable fiber is then laid over the aforementioned underlayment. Preferably, the covering 10 is draped over the ridge 70 with opposite sides 11 and 13 that extend downwardly over the two sides of the roof 30. Preferably, the area of the tufted outer covering 10 is coextensive with the entire surface of roof 30 so that seaming of the outer covering 10 can be precluded. When seaming is necessary, the edges of adjacent coverings are closely butted together and then seamed, and the adjacent tufts of the discontinuous loops are feathered or blended together to hide the seam. The covering can be attached securely to the roof by various means. Preferably the covering is nailed or stapled to the underlayment and rafters with galvanized nails or staples. Preferably staples are applied with staple guns for rapid installation of the roofing. Usually, no other attachment will be necessary. If desired, additional attachment means can be provided for roofs in high velocity wind locations. Such attachment means can include steel cables which can be laid over the outer covering 10 and worked into the mat of the covering so that the cables are not visible. The cables can be laid vertically, horizontally or a combination of both directions can be used, and can be attached to the underlayment and rafters with metal staples.

Figure 6:
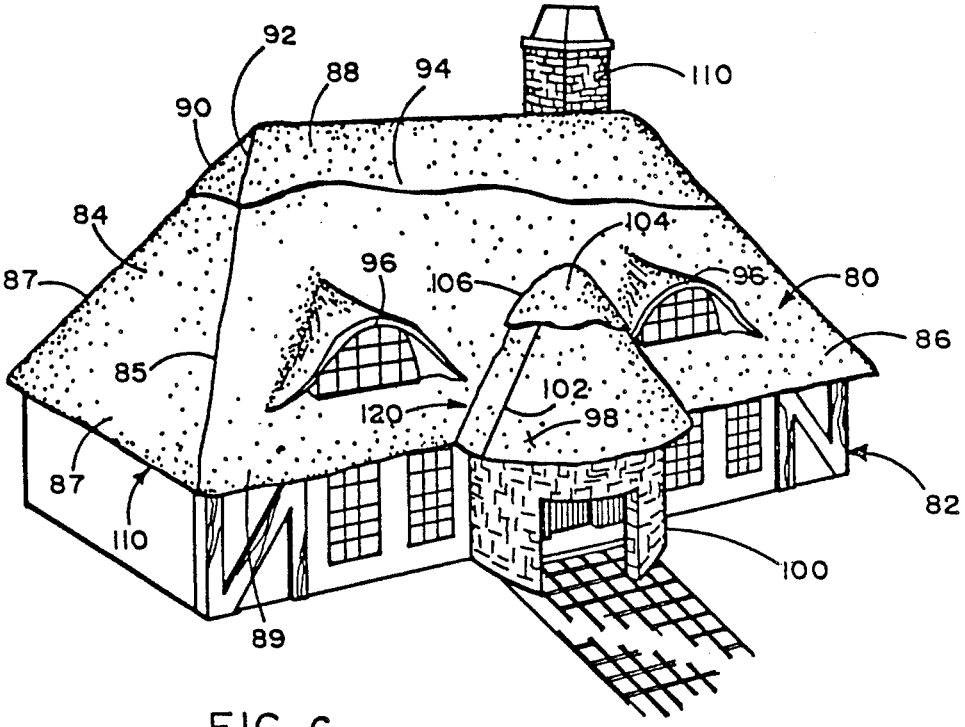
FIG. 6 illustrates a roof in accordance with the invention.

Referring now to FIG. 6, there is illustrated a roof 80 in accordance with the invention. The roof is illustrated on a cottage 82 and is of a hip roof construction with end roof panels 84 and a large frontal surface 86. The roof is illustrated with a ridge cap 88 that is formed of the same material and that has end corners 90 which are formed and are seamed along a seam line 92 to closely conform to the roof contour. The lower edge 94 of the ridge cap 88 can be formed in any desirable pattern such as the scalloped edging which is illustrated. If desired, the ridge cap 88 can also be formed of an outer covering mat which has a contrasting color, pattern or material. This mat can also have a woven pattern which is custom woven for the application. Also, if desired, the ridge cap can even be formed of metal sheathing, e.g., of copper, aluminum, or galvanized steel. If desired, the steel can be painted and the aluminum can be anodized or painted to a desired color. One advantage of the outer covering of this invention is that it is entirely adaptable to a wide variety of design patterns and applications.

One desirable feature of the outer covering 10 is its ability to be formed into any compound curvature, permitting the construction of the roof about eyebrow openings 96 as desired to provide windowed dormers which penetrate the roof surface 80. Since the outer covering 10 is completely flexible, it can assume any desired curvature or contour and only requires proper construction of the underlayment to form the desired contour in the eyebrows such as 96. The flexibility of the covering is further illustrated by the roof 98 over the turret 100 of cottage 82. The flexible outer covering 10 can be cut into the necessary preformed shape for forming a conical roof covering 98 with a minimum of seams; for small diameter turrets, only a single seam 102 would be necessary. Although this seam 102 is shown in the drawing, the seam would be entirely invisible since the edges of the outer covering 10 are butted into a close fit and then sewn together and the adjacent tufts of the discontinuous loops in the covering are feathered together, completely masking the seam. The turret roof 98 is also provided with a cap 104 having an edge 106 which matches the contour of the continuous edge 94 of the ridge cap 88.

Figure 7:
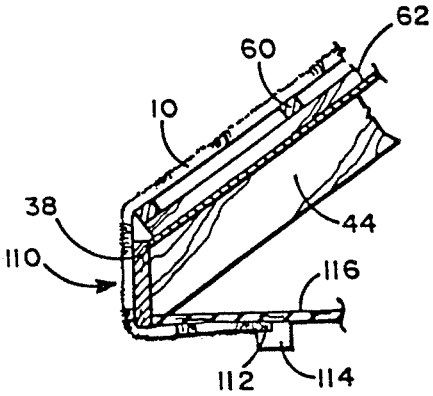
FIG. 7 illustrates the detail of the roofing along the fascia of the roof.

Referring now to FIG. 7, the detail of the construction along the lower roof edge 110 will be described. As shown in FIG. 7, the ends of rafters 44 terminate in attachment to a fascia board 38, and the underlayment formed of sheathing 48, and vertical battens 62 and horizontal battens 60 supports the outer covering 10. In some applications, the outer ends of the rafters will be totally enclosed with a soffit 116. The outer covering 10 extends downwardly to cover the fascia board 38. Preferably, the lower edge 112 of the outer covering is rolled under the fascia board and is secured in place with nails or staples to the undersurface of the soffit 116, or when a soffit is not present, to the lower edges of the rafters and inside surface of the fascia board. Preferably a trim board 114 is applied horizontally across the edge 112 of the outer covering 110. The covering 10 can also be extended to the wall of the building, totally enclosing the eve.

Figure 8:
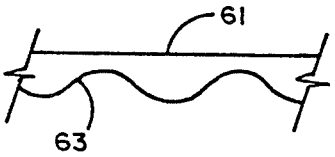
FIG. 8 illustates an alternative batten for use in the invention.

The vertical battens can be eliminated in the construction by use of horizontal battens having the shape shown in FIG. 8. As there ilustrated, the batten 61 has a lower edge 63 which scalloped, thus avoiding the possibility that the batten could form a dam preventing water run off from the roof. Any other construction providing a discontinuous lower edge to the batten 61 could also be used for this purpose.

When the roof is penetrated by upright projections such as chimney 110, these projections are flashed with metal flashing in the conventional manner and the flashing is sealed with the underlayment layers, particularly the layers of resin impregnated paper and resin coating, previously described. The roof covering of this invention can be readily cut and seamed to accomodate any number of vent pipes and can be readily formed about other roof openings such as skylights, thus not requiring any compromise in the building construction, other than that which may be desired to preserve the authenticity of the appearance of a thatched roof.

Figure 9:
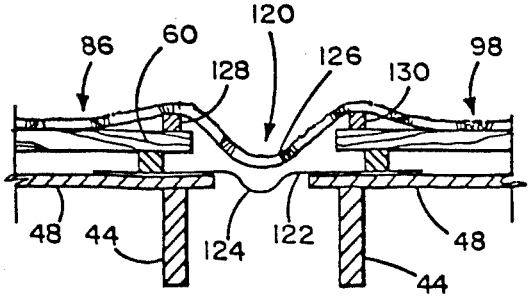
FIG. 9 illustrates the detail of a valley construction in the roofing of the invention.

The roof covering of the invention also adapts well to roofs of complex shape. FIG. 9 illustrates the construction used along a valley in the roof such as valley 120 formed between the roof surface 86 with the lurret roof 98, shown in FIG. 6. Coventional valley flashing 122 is installed over the valley 120 and this flashing has a trough 124 which is laid along the joint between the adjacent roof surfaces 86 and 98. The battens 60 and 62 are positioned in their horizontal and vertical patterns, as previously described, and the outer covering 10 is laid over the surfaces and joined along the valley in a continuous seam 126. Preferably the valley shape is accentuated by positioning vertical battens 128 and 130 on opposite sides of the valley, laterally offset from the trough 124 a slight distance, thus creating a slightly raised undulation in the roof covering 10 on opposite sides of the valley.

The edges of the roof such as edges 85 and 87 are seamed in a continuous butt seam by sewing the adjacent edges. The roof covering is trimmed along the jack rafter to provide closely abutting edges of the end panel 87 of the roof covering with the main frontal roof covering 89. These abutting edges are then joined in a continuous seam and the adjacent tufts of the discontinous loops are feathered or blended together, eliminating any appearance of a seam.

The fibers which are preferred for the outer covering 10 are cellulosic vegetable fibers which can be used in their raw or purified states. Preferably a more authentic appearance can be achieved when the fibers are used in their unpurified or raw state. The vegetable fibers which are used are bast or leaf fibers or combinations of these fibers. Examples of the various bast fibers, which are fibers obtained from the stalks of dioctyledonous plants are: jute, hemp, ramie, kenaf and sunn. Of these, jute and hemp are preferred because of the availability. Examples of leaf fibers which can be used are abaca, sisal, henequen, kantala, maguey, phormium, istle, pineapple, sansevieria and yucca. Of the aforementioned, sisal and abaca (often referred to as manila hemp) or coir fibers, are preferred, again for their availability.

The aforementioned raw cellulosic fibers are often processed to purified fibers useful for fine fabrics and cloth by mechanical, chemical or microbial destruction of the lignin which bonds the individual cellulosic fibers into coarse strands. For application in this invention, such purification is not employed and the fibers are used in their natural state with the lignin bonding of individual fibers.

The outer covering 10 is preferably treated to impart fire retardency thereto. For this purpose various materials can be used, the most commonly employed being inorganic phosphate salts which are impregnated into the fibers. Preferably the fibers are pretreated with reagents which will form insoluble phosphates in the interstities between the fibers by treatment of the outer covering 10 with a phosphate precipitant such as calcium or magnesium hydroxide followed by reaction with phosphoric acid. These chemicals are applied dilute and can be applied under sufficient pressure to deeply impregnate the fibers. Another chemical which can be used to provide fire retardency is alumina trihydrate. The alumina can be applied as a suspension in a suitable film forming agent such as a latex of rubber of a synthetic film forming polymer and, if desired, can be applied under sufficient pressure to impregnate the fibers with an alumina trihydrate coating. Either of the aforementioned chemicals imparts fire retardency; the phosphates functioning as an ignition blocking chemical and the alumina trihydrate functioning as an intumescent agent which liberates water and forms a hard refractory surface that resists ignition when it is exposed to a flame. Pigments or dyes can be added to the aforementioned fire retardant chemicals to preserve the natural appearance of the raw fibers and to avoid the white or grey appearance of salt deposits.

The life of the outer covering can be extended by various chemicals which can be applied to the covering. When raw or unpurified fibers are used, the fibers have a natural wax content which provides some water repellancy. This can be increased by coating the fibers with wax, or wax like polymers, such as polyolefins and copolymers thereof with other vinyl moners such as vinyl acetate. Fire retardancy can be incorporated in these coatings by use of chlorine and bromine substituted waxes and wax like polymers such as chlorinated polymers of ethylene and copolymers of ethylene and vinyl acetate. The fibers can be dipped in a bath of the aforementioned materials, or the materials can be sprayed onto the fibers, either before or after the fibers are formed into the coverings 10 shown in FIGS. 1, 2 and 3, or the reeds are embedded into the layer 23 shown in FIG. 4.

If desired, pesticides can also be incorporated in the fibers to increase the pest resistance of the roof. Examples include the biotanicals such as pyrethrins, rotenone, nicotine; chlorinated hydrocarbons such as Lindane, Dieldrin, Aldrin, DDT; and organophosphates such as Ronnel, Parathion, Malathion, Phorate; etc. The pesticide treatment can be applied separately, or can be combined with the application of the waxy water repellant treatment mentioned in the preceding paragraph.

The roof covering of the invention can be applied on roofs of any pitch or configuration. Since the roof covering 10 is completely flexible and since the adjacent or abutting edges can be readily sewn into an invisible seam, virtually any roof design or configuration can be covered with this material. To preserve the simulation of naturally thatched roofs, it is preferred to apply the roof covering to the traditional, steeply pitched roofs characteristic of thatched roofs, i.e., roof pitches of 45 degrees or greater. Nevertheless, the covering is entirely adaptable to roofs of lesser pitch.

The roof covering can be applied with relatively unskilled laborers since the underlayment construction follows substantially the practice of conventional roofing and the application of the outer covering 10 simply involves the unrolling or unfolding of the preformed outer covering 10, or unpacking of boxes of tiles of the covering. When necessary, the outer covering can be cut at the necessary seam lines and, if a continuous layer is desired or required, the adjacent or abutting edges of the covering can be sewn into a smooth and invisible seam.

The entire roof covering of the invention is water repellent, since this feature is achieved by proper construction of the underlayment and is also resistant to fire, and rodent intrusion. The outer covering forms a protective and thermally insulating blanket over the roof.

The finished roof closely simulates the appearance of a conventionally thatched roof since the exposed cut ends of the tufts of discontinuous loops very closely simulate the cut ends of the water reeds of a thatched roof. This appearance so closely simulates the thatched roof that only a very experienced and trained observer can discern the differences. Nevertheless, the roof construction of this invention is modest in expense and in many applications is no greater than that of conventional shingle or tile roofing.

The invention has been described with reference to the illustrated and presently preferred embodiment. It is not intended that the invention be limited by the specifically illustrated embodiment. Instead, it is intended that the invention be defined by the means, and their obvious equivalents, set forth in the following claims.

What is claimed is:

1. A simulated thatched roof formed of:

(a) a supporting roof structure including a roof frame and base underlayment; and (b) an outer covering having a thickness from 0.25 to 3 inches and laid over said frame and base underlayment and comprising:

(i) a base layer formed of a sheet of non-fibrous natural or synthetic plastic;

(ii) a plurality of tufts of a natural or synthetic fiber with cut ends exposed to form a cut pile surface and anchored into said base layer and passing upwardly, substantially perpendicular thereto to provide a continuous cut pile surface of exposed cut fiber ends, simulating the appearance of natural reed roof thatching.

2. The simulated thatched roof of claim 1 including a wire screen covering overlying said base underlayment and covered by said outer coating.

3. The simulated thatched roof of claim 1 wherein said fibers of said outer covering are coated with a fire retardant agent.

4. The simulated thatched roof of claim 1 wherein said tufts of fiber are a natural, bast or leaf fiber.

5. The simulated thatched roof of claim 4 wherein said tufts of fiber are coir fiber.

6. The simulated thatched roof of claim 1 wherein said natural or synthetic fiber is a natural, bast or leaf fiber selected from the class consisting of sisal, hemp, abaca, coir, and mixtures thereof.

7. The simulated thatched roof of claim 6 wherein said natural raw fiber is sisal.

8. The simulated thatched roof of claim 1 wherein said underlayment comprises a continuous wood sheathing coextensive with the entire surface of said roof.

9. The simulated thatched roof of claim 8 including a water-impermeable coating overlying said wood sheathing and covered by said outer covering.

10. The simulated thatched roof of claim 8 including a plurality of battens laid horizontally across said underlayment and secured thereto and overlaid with said outer covering, to provide for air circulation beneath said outer covering.

11. The simulated thatched roof of claim 1 including a second outer covering overlaid on said first outer covering and extending horizontally along the ridge of said roof and vertically over said first outer covering for a distance of approximately six to about 100 inches.

12. The simulated thatched roof of claim 11 wherein the second outer covering has a contrasting appearance to said first outer covering.

13. The simulated thatched roof of claim 11 wherein the edges of said second outer covering are scalloped to provide a decorative pattern on said roof.

14. The simulated thatched roof of claim 1 including a water-impermeable coating overlying said base underlayment and covered by said outer covering.

15. The simulated thatched roof of claim 14 wherein said water-impermeable coating comprises a plastic film.

16. The simulated thatched roof of claim 14 wherein said water-impermeable coating comprises a resin-impregnated paper.

17. The simulated thatched roof of claim 16 wherein said resin-impregnated paper is a petroleum resin impregnated felt paper.

18. The simulated thatched roof of claim 1 wherein said base layer comprises a fabric bearing a natural or synthetic resin coating on its surface.

19. The simulated thatched roof of claim 18 wherein said fabric is formed of a nonwoven layer of fibers which are consolidated into a cohesive sheet with said coating of resin.

20. The simulated thatched roof of claim 18 wherein said fabric is formed of a woven layer of fibers.

21. The simulated thatched roof of claim 18 wherein said base sheet is formed entirely of a natural or synthetic resin with a thickness from 0.1 to 1.0 inch and the ends of said tufts of fibers are embedded in said base sheet to provide an outer covering with a thickness from 0.5 to 1.5 inch.

22. The simulated thatched roof of claim 21 wherein said base sheet is formed of polyvinyl chloride.

* * * * *